United States Patent [19]

Kato et al.

[11] 3,952,132

[45] Apr. 20, 1976

[54] RECORDING SHEET

[75] Inventors: Hajime Kato; Takao Hayashi, both of Fujinomiya; Teruo Kobayashi, Minami-ashigara, all of Japan

[73] Assignee: Fuji Photo Film Co., Ltd., Minami-ashigara, Japan

[22] Filed: Nov. 16, 1973

[21] Appl. No.: 416,544

[30] Foreign Application Priority Data

Nov. 21, 1972 Japan ..... 47-116891

[52] U.S. Cl. ..... 428/341; 427/145; 427/146; 427/151; 428/323; 428/411

[51] Int. Cl.[2] ..... B41C 1/06; B41M 5/16

[58] Field of Search ..... 117/36.2, 36.8; 428/411, 323, 341; 427/145, 146, 151

[56] References Cited

UNITED STATES PATENTS

| | | | |
|---|---|---|---|
| 2,505,470 | 4/1950 | Green | 117/36.9 |
| 2,505,489 | 4/1950 | Green | 117/36.9 |
| 2,550,471 | 4/1951 | Green et al. | 117/36.9 |
| 3,418,250 | 12/1968 | Vassiliades | 117/36.2 X |
| 3,663,256 | 5/1972 | Miller et al. | 117/36.2 |
| 3,723,156 | 3/1973 | Brockett et al. | 117/36.8 X |
| 3,732,120 | 5/1973 | Brockett et al. | 117/36.9 X |

*Primary Examiner*—Thomas J. Herbert, Jr.
*Attorney, Agent, or Firm*—Sughrue, Rothwell, Mion, zinn & Macpeak

[57] ABSTRACT

This invention provides a novel recording sheet having improved developing ability and resistance to light irradiation and which can be produced easily and economically. A developer layer coated on a support of the recording sheet contains a reacted compound between an alkali metal salt of a phenol resin and a water soluble metallic compound.

7 Claims, No Drawings

RECORDING SHEET

BACKGROUND OF THE INVENTION

1. Field of the Invention

This invention relates to a recording sheet, and more particularly to a recording sheet using an improved developer.

2. Description of the Prior Art

A recording sheet which makes use of a coloring reaction between a substantially colorless organic compound (hereinafter designated "coloring agent") and an absorbent or reacting compound (hereinafter designated "developer") which is colored upon contact with the coloring agent is well known. Among the coloring agents, there are Malachite Green lactone, benzoyl leucomethylene blue, crystal violet lactone, Rhodamine B lactam, 3-dialkylamino-7-dialkylaminofluoran, 3-dialkylamino-7-N-aryl N-alkylamino fluoran and 3-methyl-2, 2-spirobi(benzo [f] chromene).

As the recording sheet employing this coloring reaction, there are the pressure sensitive copying papers (for example as described in U.S. Pat. Nos. 2,505,470; 2,505,489; 2,550,471; 2,548,366; 2,712,507; 2,730,456; 2,730,457; and 3,418,250) and heat sensitive copying papers. (For example as described in Japanese Pat. No. 4160/67 and U.S. Pat. No. 2,939,009).

On the other hand, a printing process for obtaining a colored image comprising feeding an ink containing the coloring agent in a solvent through a stencil or the like on a sheet applied with the developer is described in German Pat. No. 1,939,624.

Usually, the coloring reaction between the developer and the coloring agent requires the pressure of a pen or typewriter, or another physical stimulus.

A pressure sensitive copying paper, a typical example of copying papers, is produced by dissolving the coloring agent in a solvent such as alkylated naphthalene, alkylated diphenyl or alkylated diphenylmethane, dispersing the solution in a binder or encapsulating the solution in microcapsules, and applying the solution thus treated on a sheet of paper, plastic, resin coated paper or a like support.

On the other hand, a heat sensitive copying paper is produced by applying the coloring agent on the support together with acetanilide, para-toluene-N, N-diethylsulfonamide or a like thermofusable material. A thermofusing material is a material which is fused by heat and dissolves the coloring agent.

The developer is dissolved or dispersed in water or an organic solvent together with a binder, and the resulting solution or dispersion is applied on or impregnated in the support. The developer can be applied on or impregnated in the support as the ink.

Generally, the coloring agent and the developer are applied on the same surface or mutually different surfaces of the support, or on mutually different supports.

Known developers are acidic terra alba, activated terra alba, attapulgite, zeolite, bentonite or like clays, succinic acid, tannic acid, gallic acid, phenol compounds or like organic compounds, and phenol resins or like acidic polymers. Especially, the phenol resin is given attention as a novel developer in Japanese Pat. No. 20144/67, and various improvements on phenol resin developers have been proposed, for example, in U.S. Pat. Nos. 3,516,845; 3,525,630; 3,540,911; and 3,634,121; British Pat. Nos. 1,065,587; and 1,215,618.

According to such prior art, the phenol resin is divided into fine particles and dispersed in water, or mixed with gum arabic in a ball mill and dispersed in water, or otherwise dissolved in an organic solvent.

The prior art, however, has the following defects: In using fine particles of the phenol resin, the preparation of the fine particles is difficult and requires much time. It is desirable that the particle size of the resin be small to obtain sufficient color density. However, the minimum particle size is restricted by grinding methods and a large amount of the ground resin must be used in order to obtain sufficient color density.

In a case of preparing the coated solution by mixing the phenol resin with gum arabic or water in a ball mill, the preparation of the coating solution requires much time and in addition the batch size of the coating solution is restricted by the working conditions. Accordingly, the preparation of the coating solution on a commercial scale is difficult.

In dissolving the phenol resin in a solvent, means for protecting against explosion must be attached to the apparatus in which the coating solution is prepared and to the coater, since the solvent is often poisonous and easily inflammable.

As described above, the prior art for the preparation of phenol resin containing coating solutions have various defects and do not utilize fully the developing property of the phenol resin.

Japanese Pat. No. 20971/72 and British Pat. No. 1,215,618 disclose that the developing ability of the developer sheet and the light resistance of the colored image on the developer sheet are improved by adding a chloride, nitrate, sulfate and acetate of a bivalent metal, such as cadmium, calcium, magnesium, barium, manganese, nickel or the like. In such case, however, both the developing ability of the phenol resin and the effect of the bivalent metal salt are not fully exhibited as the fine particles of phenol resin are used usually.

An object of this invention is to provide a novel recording sheet having improved developing ability.

Another object of this invention is to provide a recording sheet having a color image of improved light resistance.

A further object of this invention is to provide a process for producing a recording sheet in which the coating solution can be simply prepared.

SUMMARY OF THE INVENTION

The above described objects of this invention are achieved by using a reacted mixture of an alkali metal salt of phenol resin and a water soluble metal salt.

DETAILED DESCRIPTION OF THE INVENTION

The phenol resin used in this invention is one which generates hydrogen protons as is known in the art; more specifically, the term "phenol resin" means a phenol-aldehyde polymer (the so-called novolak type phenol resins) and a phenol acetylene polymer, with these polymers generally having a degree of condensation of about 2 to 10.

The phenol resin includes p-phenyl phenol-formaldehyde polymer, p-fluorophenol-formaldehyde polymer, p-chlorophenol-formaldehyde polymer, p-bromophenol-formaldehyde polymer, p-iodophenol-formaldehyde polymer, p-nitrophenol-formaldehyde polymer, p-carboxyphenol-formaldehyde polymer, o-carboxyphenol-formaldehyde polymer, p-carboalkoxyphenol-formaldehyde polymer, p-aroylphenol-formaldehyde polymer, p-lower alkoxyphenol-formaldehyde polymer, copolymer of formaldehyde with p-alkyl ($C_1$–$C_{12}$)phenol, (e.g., p-methylphenol, p-ethylphenol, p-n-propylphenol, p-isopropylphenol, p-n-amylphenol, p-isoamylphenol, p-cyclohexylphenol, p-1,1-dimethyl-n-propylphenol, p-n-hexylphenol, p-isohexylphenol, p-1,1-dimethyl-n-butylphenol, p-1,2-dimethyl-n-butylphenol, p-1,2-dimethyl-n-butylphenol, p-n-heptylphenol, p-isoheptylphenol, p-5,5-dimethyl-n-amylphenol, p-n-octylphenol, p-1,1,3,3-tetramethylbutylphenol, p-isooctylphenol, p-n-nonylphenol, p-isononylphenol, p-1,1,3,3-tetramethylamylphenol, p-n-decylphenol, p-isodecylphenol, p-n-undecylphenol, p-isoundecylphenol, p-n-dodecylphenol), the isomers of these p-alkylphenols (in which the number of carbon atoms in the alkyl groups is 1–12), and a mixture containing two or more of these alkylphenols and the isomers thereof. The m-substituted derivative can be added to the p-substituted phenol without reducing the action thereof.

The phenol resin can be usually applied on the support surface by any of the aforesaid coating methods, but it is important for the process of this invention to apply an aqueous dispersion of both the alkali metal salt of the phenol resin and the water soluble metallic compound on the support surface. Accordingly it is ineffective to apply the alkali metal salt of the phenol resin and the water soluble metallic compound separately on the support surface. Thus, the recording layer on the support surface produced according to the process of this invention contains both the metal salt of the phenol resin and the alkali salt in the mixed state. It has been generally believed that the alkali metal salt and the water soluble metallic compound do not react with each other, but in contrast to prior beliefs both possibly react with each other or one covers the surface of the other in the recording layer, in view of unexpected effects of this invention.

The water soluble compound which can be used in this invention includes the water soluble compounds of copper, silver or like elements in Group IB of the periodic table, magnesium, calcium or like elements in Group IIA, zinc, cadmium, mercury or like Group IIB elements, aluminum, gallium or like Group IIIA elements, tin, lead or like Group IVA elements, chromium, molybdenum or like Group VIB elements, mangenese or like Group VII elements, and cobalt, nickel or like Group VIIIB elements, for example, the chlorides, sulfates, nitrates and acetates of these elements. Especially, the water soluble compounds of zinc, tin, magnesium, aluminum and nickel are most effective.

As described above, the recording sheet of this invention is characterized by using a developer layer containing a reacted mixture between the alkali metal salt (the term alkali metal salt means the sodium salt, the potasium salt and the lithium salt) of a phenol resin and the water soluble metallic compound. The method of preparation of the developer coating liquid is not restricted to any specific method. An example of the preparation of the developing coating liquid will be described below.

In order to form the alkali metal salt of phenol resin, the phenol resin is added to an aqueous solution of an alkali metal compound, such as lithium hydroxide, in amounts of nearly equal molar proportion. The ratio of the phenol resin and the alkali metal compound is basically dependent upon the number of phenolic OH groups of the resin and an amount of the alkali metal compound equivalent to or less than the number of such phenolic groups. The reaction is the substitution for the hydrogen atom of the phenolic OH group with an alkali metal atom. The phenol resin does not dissolve in water but dissolves relatively well in an alkali aqueous solution such as sodium, hydroxide, potassium hydroxide, sodium carbonate, potassium carbonate, with hydroxides being preferred. In particular, the dissolution is accelerated as the alkali aqueous solution is heated, e.g., at 20° to 100°C, preferably 50° to 100°C. Since the phenol resin can be dissolved in the alkali solution at a temperature below the room temperature (about 20° to 30°C), the heating of the alkali solution is not essential for the preparation of the coating solution, however.

An aqueous solution of a water soluble metallic compound is added to the aqueous solution of the alkali metal salt of the phenol resin thus obtained. The amount of the water soluble metallic compound to the alkali metal salt of phenol resin is more than 0.1 gram equivalent, e.g., 0.3 to 5 gram equivalents, preferably 0.5 to 3 gram equivalents, more preferably about 1 gram equivalent, to 1 gram equivalent of the alkali metal salt of the phenol resin. The mixing of the alkali metal salt of the phenol resin with the water soluble metallic compound can be carried out by the agitation or any other processing means.

Of course, the aqueous solution of the alkali metal salt of phenol resin can be added to the aqueous solution of the water soluble metallic compound, or both of them can be added in any order to an aqueous dispersion of a white pigment, such as titanium dioxide. The amounts of the ingredients are also determined in the abovesaid ranges. In order to facilitate the application of the aqueous dispersion of the resultant mixture, the temperature thereof is preferably elevated. The temperature of the liquid mixture can be kept at room temperature, but is preferably elevated to above about 40°C, e.g., up to 100°C, preferably in the range of 40° to 70°C for improving subsequent handling, for example, to reduce the viscosity of the liquid. Equally favorable results are obtained by reacting the aqueous solution of the water soluble metallic compound with the aqueous solution of the alkali metal salt of the phenol resin in the presence of water soluble high molecular weight compounds, for example proteins such as gelatin, gum arabic, albumin or casein; celluloses such as carboxymethylcellulose or hydroxyethylcellulose; polysaccarides such as agar, sodium alginate, starch or carboxymethyl starch; synthetic polymers such as polyvinyl alcohol, polyvinyl pyrrolidone, polyacrylic acid, polyacrylamide, etc. The water soluble high molecular compound generally is used in an amount of 5 to 100 parts, preferably 20 to 70 parts, by weight based on 1 part of the water soluble metallic compound. In other words, favorable results are obtained by introducing the water soluble high molecular weight compounds into the mixture of both of the aqueous solutions before reacting with each other. The solution mixture thus obtained is preferably applied on the support surface solely or together with the binder or other additives. The solution mixture after being dried can also be used. Various known binders can be used, for example styrene-butadiene copolymer latex or like latexes, polyvinyl alcohol, maleic anhydride-styrene copolymer, starch, casein, gum arabic, carboxymethyl cellulose and like synthetic or natural high molecular weight substances.

The above described coating liquid has its own developping ability, but, if necessary, conventional developrs such as acidic terra alba or activated terra alba, and/or inorganic pigments such as zinc oxide or magnesium carbonate can be added to the coating liquid to increase the developing ability.

In order to produce the recording sheet of this invention, the coating liquid is applied on a paper, a composite paper, a film or a like support in amount of more than 0.1 g/m², preferably 0.3 to 2 g/m², as the amount of the phenol resin. The upper limit of the coating amount is mainly determined from an economic standpoint, and accordingly, the function of the recording sheet is not diminished with an application of higher amounts of the coating liquid.

On the other hand, the amount of the binder used is more than 5 weight parts, preferably 10 to 15 weight parts, per 100 weight parts of the solids in the coating liquid, although this can change somewhat depending on the amounts and kinds of binders and additives. The amount of the binder is determined by ballancing the developing ability and the coating strength, and accordingly as little binder as possible is used if a sufficient coating strength is obtained.

Since the recording sheet of this invention is especially characterized by the developer, the other production conditions, such as the kind and form of the coloring agent, and the kind of the solvent, can be easily selected from those used in the prior art.

Coloring agents suitable for the recording sheet according to this invention include all those substances which are electron receivers or proton donors, in other words, which are colored by reacting with the developer. There are, for example, diaryl methane coloring agents (as disclosed in Japanese Pat. No. 14873/61, U.S. Pat. No. 2,828,342) triarylmethane coloring agents (as disclosed in Japanese Pat. Nos. 29547/71, 29548/71), fluoran coloring agents (as disclosed in Japanese Pat. No. 21199/68, Japanese Pat. Nos. 10479/72, 4662/72), spiropyran coloring agents (as disclosed in British Pat. No. 810,401, Japanese Pat. No. 15327/71) and leucoazine coloring agents (as disclosed British Pat. No. 791,426, Japanese Pat. No. 10238/72).

The recording sheet of this invention can be produced in accordance with prior art techniques except for using the particular developer.

The developing ability of this recording sheet and the light resistance of the developed image are excellent as compared with that of the conventional phenol resin recording sheet. In addition, the production of this recording sheet is greatly simplified in that the step of pulverizing the phenol resin in the preparation of the aqueous dispersion of the phenol resin is not required. The anti-explosion devices required in the case of using organic solvents also is unnecessary.

Now, the invention will be described in greater detail with reference to particular embodiments of this invention as set forth in the following Examples. Unless otherwise indicated all parts and percents are by weight.

The effects of the invention were confirmed using a combination of an upper sheet having microcapsules applied thereon as described hereinafter and a lower sheet upon which the developper according to this invention had been applied.

The microcapsules containing the coloring agent can be produced by various known processes. In the examples of the process of this invention, the microcapsules were produced according to the process described in U.S. Pat. No. 2,800,457, as follows:

Acid treated pig skin gelatin 10 weight parts and gum arabic 10 weight parts were dissolved in water 400 weight parts kept at 40°C; turkey red oil 0.2 weight parts as the emulsifying agent was added to the solution and coloring oil 40 weight parts was further added to and dispersed in the solution. The coloring oil was prepared by dispersing 2% of crystal violet lactone (CVL) or 3-N, N-diethylamino fluoran in diisopropylnaphthalene. The emulsification was stopped when the mean oil drop size became 5 microns. Water of 40°C was added to the resultant emulsion to obtain a liquid 900 cc, which was kept agitated.

Then, 10% acetic acid was added to the emulsion to adjust the pH in the range of 4.0 to 4.2, and coacervation resulted.

After 20 min. of agitation, the emulsion was cooled with ice water to gel the coacervate membrane. When the liquid temperature was reduced to 20°C, 7 parts of 37% formalin were added to the liquid. When the liquid temperature was reduced to 10°C, an aqueous solution of NaOH was added to the liquid to adjust the pH to 9. Then the agitation was continued for 20 min., while heating the liquid to 50°C.

The temperature of the microcapsule dispersion thus obtained was adjusted to 30°C, and the dispersion was applied in amount of 5 g/m² to a paper sheet having the weight of 40 g/m². After drying, a test microcapsule sheet was obtained.

EXAMPLE 1

Both paraphenyl phenol 170 parts and 37% formaldehyde aqueous solution 70 parts were reacted with each other at 140°C for 10 hr. in the presence of concentrated HCl (37%) 10 parts and water 50 parts. After cooling, the reacted phenol resin material was obtained as a powder.

The phenol resin thus obtained 183 parts was dissolved in a 4% hydroxide aqueous solution 1000 parts and heated and agitated, and various solutions of the water soluble metallic salts listed in the following Table 1, each dissolved in 300 parts water, were added gradually to above solution at 45°C. As the metallic salt solution was added, the latter solution become opaque and an emulsion, and the pH of the reacted solution became neutral.

A 10% polyvinyl alcohol aqueous solution 300 parts was added to the resulting solution to produce the coating solution. The coating solution was applied to in an amount of 1 g/m² on a solids basis to a paper sheet having a unit weight of 50 g/m² using a coating rod.

COMPARATIVE EXAMPLE 1

A coating solution was prepared by adding water 1500 parts and a 10% polyvinyl alcohol aqueous solution 300 parts to the phenol resin 183 parts obtained in Example 1, and then the mixture was blended in a ball mill for 10 hr. The coating solution obtained was applied in amount of 1 g/m² on a solids basis to a paper sheet having a unit weight of 50 g/m² by using a coating rod.

COMPARATIVE TEST 1

A microcapsule sheet containing crystal violet lactone or 3-N, N-dibenzilamino-7-N, N-diethylamino fluoran was superimposed on the developer sheet according to Example 1 and Comparative Example 1, and 600 Kg/cm² of compressing pressure was applied to the laminated sheet to develop the color.

The density of the developed color of the test specimens, one of which was exposed 1 day in the dark and another was exposed to sunlight for 2 hrs., was measured by detecting the degree of light absorbance at the maximum absorption in the reflecting spectrum of a wave length range between 380 mμ and 700 mμ using a $D_B$ type Beckman spectrophotometer. The test results obtained are shown in Table 1.

Table 1

| Specimen No. | Water Soluble Metallic Salt | | Crystal Violet Lactone (610 mμ) Density of Developed Color Exposed in the Dark for 1 Day | Crystal Violet Lactone (610 mμ) Density of Developed Color Exposed to Sunlight for 2 Hours | 3-N,N-Dibenzilamino-7-N,N-diethylaminofluoran (600 mμ) Density of Developed Color Exposed in the Dark for 1 Day | 3-N,N-Dibenzilamino-7-N,N-diethylaminofluoran (600 mμ) Density of Developed Color Exposed to Sunlight for 2 Hours |
|---|---|---|---|---|---|---|
| | (parts) | | | | | |
| *1 | — | | 0.65 | 0.22 | 0.43 | 0.15 |
| 2 | $ZnSO_4.7H_2O$ | 144 | 0.95 | 0.65 | 0.71 | 0.36 |
| 3 | $ZnCl_2$ | 68 | 0.82 | 0.60 | 0.61 | 0.30 |
| 4 | $MgSO_4.7H_2O$ | 123 | 0.80 | 0.66 | 0.62 | 0.38 |
| 5 | $SnSO_4$ | 107 | 0.82 | 0.78 | 0.59 | 0.50 |
| 6 | $Al_2(SO_4)_3.17H_2O$ | 108 | 0.73 | 0.53 | 0.52 | 0.29 |
| 7 | $PbSO_4$ | 152 | 0.67 | 0.45 | 0.48 | 0.23 |
| 8 | $CoSO_4.7H_2O$ | 140 | 0.68 | 0.33 | 0.47 | 0.18 |
| 9 | $FeSO_4.7H_2O$ | 139 | 0.66 | 0.37 | 0.45 | 0.19 |
| 10 | $SnCl_2.2H_2O$ | 113 | 0.80 | 0.77 | 0.60 | 0.52 |
| 11 | $NiSO_4.7H_2O$ | 140 | 0.69 | 0.34 | 0.47 | 0.20 |

*1 Comparative Example 1 Specimen
2–11 Example 1 Specimens

EXAMPLE 2

Both paraphenyl phenol 170 parts and 37% formaldehyde aqueous solution 70 parts were polymerized at 170°C for 8 hrs. in the presence of concentrated HCl (37%) 10 parts and water 50 parts. After cooling, the reacted phenol resin material was obtained in a powder form.

The phenol resin thus obtained 183 parts was dissolved in a 4% sodium hydroxide solution 1000 parts as heated and agitated, and a dispersion composed of water 200 parts and activated terra alba 350 parts was added to the phenol resin solution. The pH of the resultant dispersion was adjusted to 10 by adding thereto a 10% sodium hydroxide aqueous solution. Then, various solutions of the water soluble metallic salts listed in the following Table 2, each dissolved in 300 parts water, were added gradually to the above dispersion at 50°C. The viscosity of the dispersion increased to some extent during the addition of the metallic salt solution, but decreased at the end of the addition. A styrenebutadiene rubber (SBR) latex (1:1molar 1:1 48% solids) 200 parts was added to the dispersion to otain a coating solution and the coating solution was applied in amount of 3 g/m² on a solids basis to a paper sheet having a unit weight of 50 g/m² using a coating rod.

COMPARATIVE EXAMPLE 2

The phenol resin 183 parts used in Example 2 and activated terra alba 350 parts were dispersed in water 3500 parts, and the pH of the dispersion obtained was adjusted to 8 by adding a suitable amount of a 10% sodium hydroxide aqueous solution. The obtained coating solution was applied in amount of 3 g/m² on a solids basis to a paper sheet having a unit weight of 50 g/m² using a coating rod.

COMPARATIVE TEST 2

The same test as described in Compartive Test 1 was carried out using the developer sheets in Example 2 and Comparative Example 2. The test results obtained are shown in Table 2.

Table 2

| Specimen No. | Water Soluble Metallic Salt | | Crystal Violet Lactone (600 mμ) Density of Developed Color Exposed in the Dark for 1 Day | Crystal Violet Lactone (600 mμ) Density of Developed Color Exposed to Sunlight for 2 Hours | 3-N,N-Dibenzilamino-7-N,N-diethylaminofluoran (600 mμ) Density of Developed Color Exposed in the Dark for 1 Day | 3-N,N-Dibenzilamino-7-N,N-diethylaminofluoran (600 mμ) Density of Developed Color Exposed to Sunlight for 2 Hours |
|---|---|---|---|---|---|---|
| | (parts) | | | | | |
| *12 | | | 0.85 | 0.41 | 0.66 | 0.30 |
| 13 | $ZnSO_4.7H_2O$ | 144 | 1.01 | 0.74 | 0.79 | 0.59 |
| 14 | $ZnCl_2$ | 68 | 0.91 | 0.68 | 0.72 | 0.52 |
| 15 | $MgSO_4.7H_2O$ | 123 | 0.89 | 0.74 | 0.67 | 0.60 |
| 16 | $SnSO_4$ | 107 | 0.92 | 0.87 | 0.71 | 0.65 |
| 17 | $Al_2(SO_4)_3.17H_2O$ | 108 | 0.87 | 0.60 | 0.66 | 0.42 |

*12 Comparative Example 2 Specimen
13–17 Example 2 Specimens

EXAMPLE 3 p-tert-Butylphenol 194 parts and formaldehyde aqueous solution 65 parts were polymerized at 150°C for 12 hrs. in the presence of concentrated (37%) HCl 10 parts, formic acid 1 part and water 50 parts. After cooling, the reacted phenol resin material was obtained in a powder form.

The phenol resin thus obtained 163 parts were dissolved in a 4% sodium hydroxide aqueous solution 1000 parts and agitated, and a dispersion composed of water 2000 parts and kaolin 350 parts was added to the solution. Then, various aqueous solutions of water soluble metallic salts listed in Table 3, each dissolved in water 300 parts, were added gradually to the above dispersion at 40°C with the dispersion being agitated carefully.

The pH of the resultant dispersion after reacting became neutral. A 15% gum arabic aqueous solution 600 parts was added to the dispersion to obtain a coating solution, which was applied in amount of 3 g/m² or a solids basis to a paper sheet having a unit weight of 50 g/m² using a coating rod.

COMPARATIVE EXAMPLE 3

The phenol resin 163 parts obtained in Example 3 and kaolin 350 parts were dispersed in water 3500 parts, and a 15% gum arabic aqueous solution 600 parts was added to the dispersion. After that, the dispersion was kneaded in a ball mill for 10 hrs. to obtain a coating solution.

This coating solution was applied in amount of 3 g/m² on a solids basis to a paper sheet having a unit weight of 50 g/m² using a coating rod.

COMPARATIVE TEST 3

The same test as in Comparative Test 1 was carried out using the developer sheets in Example 3 and Comparative Example 3. The test results obtained are shown in Table 3.

Table 3

| Specimen No. | Water Soluble Metallic Salt | | Crystal Violet Lactone (600 mμ) | | 3-N,N-Dibenzilamino-7-N,N-diethylaminofluoran (600 mμ) | |
|---|---|---|---|---|---|---|
| | | | Density of Developed Color Exposed in the Dark for 1 Day | Density of Developed Color Exposed to Sunlight for 2 Hours | Density of Developed Color Exposed in the Dark for 1 Day | Density of Developed Color Exposed to Sunlight for 2 Hours |
| | (parts) | | | | | |
| *18 | | | 0.83 | 0.39 | 0.65 | 0.27 |
| 19 | $ZnSO_4.7H_2O$ | 144 | 0.99 | 0.72 | 0.77 | 0.57 |
| 20 | $MgSO_4.7H_2O$ | 123 | 0.86 | 0.73 | 0.65 | 0.58 |
| 21 | $SnSO_4$ | 107 | 0.92 | 0.89 | 0.70 | 0.65 |
| 22 | $Al_2(SO_4)_3.17H_2O$ | 108 | 0.86 | 0.57 | 0.62 | 0.40 |

*18 Comparative Example 3 Specimen
19–22 Example 3 Specimen

EXAMPLE 4 p-Chlorophenol 129 parts and a 37% formaldehyde aqueous solution 70 parts were polymerized at 130°C for 14 hrs. in the presence of concentrated (37%) HCl 5 parts, oxalic anhydride 2 parts and water 50 parts. After cooling, the phenol resin was obtained in a powdered form.

The phenol resin thus obtained 141 parts was dissolved in a 4% sodium hydroxide aqueous solution 1000 parts and heated and agitated, and a dispersion composed of water 2000 parts and zinc oxide 350 parts was added to said solution. Then, the various solutions of the water soluble metallic salts listed in Table 4, each dissolved in water 300 parts, were added gradually to the dispersion at 50°C with agitating carefully. After reaction, the pH of the dispersion became neutral a 15% aqueous solution 600 parts of the ammonium salt of a styrene-maleic anhydride copolymer (1:1 molar ratio) was added to the dispersion to obtain the coating solution. The coating solution was applied in amount of 3 g/m² on a solids basis to a paper sheet having a unit weight of 50 g/m² using a coating rod.

COMPARATIVE EXAMPLE 4

The phenol resin 141 parts obtained in Example 3 and zinc oxide 350 parts were dispersed in water 3500 parts, and a 15% aqueous solution of the ammonium salt of a styrenemaleic anhydride copolymer as described above 600 parts were added to the dispersion. After treatment in a ball mill for 12 hrs., the dispersion, as the coating liquid, was applied in amount of 3 g/m² on a solids basis to a paper sheet having a unit weight of 50 g/m² using a coating rod.

COMPARATIVE TEST 4

The same test as in Comparative Test 1 was carried out using the developer sheet in Example 4 and Comparative Example 4. The test results obtained are shown in Table 4.

Table 4

| Specimen No. | Water Soluble Metallic Salt | | Crystal Violet Lactone (600 mμ) | | 3-N,N-Dibenzilamino-7-N,N-diethylaminofluoran (600 mμ) | |
|---|---|---|---|---|---|---|
| | | | Density of Developed Color Exposed in the Dark for 1 Day | Density of Developed Color Exposed to Sunlight for 2 Hours | Density of Developed Color Exposed in the Dark for 1 Day | Density of Developed Color Exposed to Sunlight for 2 Hours |
| | (parts) | | | | | |
| *23 | | | 0.81 | 0.35 | 0.62 | 0.25 |
| 24 | $ZnSO_4.7H_2O$ | 144 | 0.95 | 0.70 | 0.75 | 0.55 |
| 25 | $MgSO_4.7H_2O$ | 123 | 0.82 | 0.70 | 0.60 | 0.54 |
| 26 | $SnSO_4$ | 107 | 0.90 | 0.85 | 0.69 | 0.64 |
| 27 | $Al_2(SO_4)_3.17H_2O$ | 108 | 0.83 | 0.54 | 0.61 | 0.37 |

*23 Comparative Example 4 Specimen
24–27 Example 4 Specimens

Other coloring agents known in the art also exhibit equally favorable developing ability and light resistance as that of the coloring agents described in the Examples above.

It will be apparent from the Examples and Comparative Examples that the excellent developing ability and light resistance of the developer sheet are obtained using a coating liquid produced by reacting an alkali metal salt of a phenol resin with a water soluble metallic salt.

The preparation of this coating liquid is greatly simplified according to the process of this invention.

As particularly described above, the developing ability of the developing sheet is greatly improved, the commercial value of the recording sheet is increased, and the cost for producing the recording sheet is decreased, according to the process of this invention.

While the invention has been described in detail and with reference to specific embodiments thereof, it will be apparent to one skilled in the art that various changes and modifications can be made therein without departing from the spirit and scope thereof.

What is claimed is:

1. A recording sheet for use with a coloring agent to form a colored image comprising a support having thereon a layer of developer agent comprising a reacted mixture of an alkali metal salt of a phenol resin and a water soluble metallic compound selected from the group consisting of a sulfate, a chloride, a nitrate, and an acetate compound of zinc, tin, magnesium, aluminum, or nickel.

2. The recording sheet of claim 1, wherein said phenol resin is a phenol-aldehyde novolac resin, a phenol-acetylene polymer, a p-alkyl phenol in which the alkyl group has from 1 to 12 carbon atoms, or the isomers thereof, or mixtures thereof.

3. The recording sheet of claim 2, wherein said phenol resin is a p-phenylphenol-formaldehyde polymer, a p-fluorophenol-formaldehyde polymer, a p-chlorophenol-formaldehyde polymer, a p-bromophenol-formaldehyde polymer, a p-iodophenol-formaldehyde polymer, a p-nitrophenol-formaldehyde polymer, a p-carboxyphenol-formaldehyde polymer, an o-carboxyphenol-formaldehyde polymer, a p-carboalkoxyphenol-formaldehyde polymer, a p-aroylphenol-formaldehyde polymer, a p-lower alkoxyphenol-formaldehyde polymer, p-methylphenol, p-ethylphenol, p-n-propylphenol, p-isopropylphenol, p-n-amylphenol, p-isoamylphenol, p-cyclohexylphenol, p-1,1-dimethyl-n-propylphenol, p-n-hexylphenol, p-isohexylphenol, p-1,1-dimethyl-n-butylphenol, p-1,2-dimethyl-n-butylphenol, p-1,2-dimethyl-n-butylphenol, p-n-heptylphenol, p-isoheptylphenol, p-5,5-dimethyl-n-amylphenol, p-n-octylphenol, p-1,1,3,3-tetramethylbutylphenol, p-isooctylphenol, p-n-nonylphenol, p-isononylphenol, p-1,1,3,3-tetramethylamylphenol, p-n-decylphenol, p-isodecylphenol, p-n-undecylphenol, p-isoundecylphenol, or p-n-dodecylphenol.

4. The recording sheet of claim 1, wherein said alkali metal salt is the sodium salt, the lithium salt, or the potassium salt.

5. The recording sheet of claim 1, wherein the amount of water soluble metallic compound to the amount of said alkali metal salt of said phenol resin is 0.1 to 5 gram equivalents.

6. The recording sheet of claim 1, wherein said layer of said developer agent is present on said support in a styrene-butadiene copolymer latex, polyvinyl alcohol, maleic anhydride-styrene copolymer, starch, casein, gum arabic, or carboxymethyl cellulose binder.

7. The recording sheet of claim 1, wherein said layer of said developing agent is present on said support in an amount of more than 0.1 $g/m^2$.

* * * * *